US005499795A

United States Patent [19]

Mathews

[11] Patent Number: 5,499,795

[45] Date of Patent: Mar. 19, 1996

[54] POST REMOVER

[76] Inventor: Mitchell L. Mathews, HC1 Box 228, Benson, Ariz. 85602

[21] Appl. No.: 375,715

[22] Filed: Jan. 20, 1995

[51] Int. Cl.[6] ..... E21B 19/00

[52] U.S. Cl. ..... 254/30

[58] Field of Search ..... 254/30, 31, 131, 254/132, 133, DIG. 1, 29 R

[56] References Cited

U.S. PATENT DOCUMENTS 2,777,726 1/1957 Lundgren et al. .
4,161,310 7/1979 Parker .
4,726,565 2/1988 Keller .
4,738,433 4/1988 Hoff .
5,022,632 6/1991 Beideck .
5,100,104 3/1992 Wagner .

*Primary Examiner*—Robert C. Watson
*Attorney, Agent, or Firm*—Richard C. Litman

[57] ABSTRACT

A post pulling device with a vertical support member attached to a base plate and engaging the support member and having an elongated telescoping handle connected to a reenforced C-shaped head portion. The head engages a post, specifically a T type post, and pressure is applied to the handle structure. The post is lifted out of the ground a corresponding distance. Upon raising the handle, the head "ratchets" down the post and the process is repeated. The device is rigidly constructed from sufficiently strong metal tubing to allow it to be subjected to the most rigorous conditions.

9 Claims, 3 Drawing Sheets

POST REMOVER

BACKGROUND OF THE INVENTION

1. Field of the Invention

The present invention relates to a device for removing posts embedded in the ground, i.e., a post puller.

2. Background of the Invention

In locations where large areas of land are enclosed, fencing becomes an economically significant investment. It is often necessary to move or replace these fence lines and when this occurs, the fence posts embedded in the ground must be removed or destroyed. Destroying fence posts results in waste. Removing posts is both expensive and time consuming. Previous methods for dealing with this problem have included bending or cutting the post at ground level, hoisting or pulling the post with various types of machinery, or digging out the post. All of these methods are wasteful, with respect to time or money or both. It would be desirable to have a portable and rugged device which not only is capable of quickly and easily removing fence posts from the ground, but also is operable in such a manner as to allow the post to be used again.

3. Description of the Prior Art

Prior art post pullers are well known as will be appreciated from the discussion of the prior art hereinbelow, but these prior art devices have proven to be time consuming in operation and rather delicate in construction.

U.S. Pat. No. 2,777,726, issued to L. R. Lundgren et al. on Jan. 15, 1957, discloses a post removing device which has a triangular base supporting an elongated handle and a pivotable C-shaped head. The head has a slidably adjustable lower jaw portion, with the remainder of the head being constructed of a single piece of relatively thin metal which is twisted to form the pivot point. The head is attached to the handle at only one point, resulting in the entirety of the stress being applied to that point. The overall construction of the device, including a relatively lightweight support frame, implies that its primary use would be for favorable, that is, soft ground conditions.

U.S. Pat. Nos. 4,161,310, issued to M. D. Parker on Jul. 17, 1979, 4,726,565 issued to J. A. Keller on Feb. 23, 1988, 4,738,433, issued to H. Hoff on Apr. 19, 1988, and 5,022,632, issued to M. E. Beideck on Jun. 11, 1991, illustrate post pullers, each in the form of a base supporting a single vertical support member and a handle portion attached to the top of that support member. Each post puller has a slightly different head, but the general concept is an adjustable U-shaped device which engages the post and a removable pin closing the gap formed by the head. The '632 patent also has a variety of interchangeable heads. The '565 patent discloses a spring loaded engaging pin, and the '433 device is unique in that it engages a T type post by accepting the notches of the post into the rear section of the U shaped head and then closing around it.

U.S. Pat. No. 5,100,104, issued to R. A. Wagner on Mar. 31, 1992, shows a post remover which uses an engaging arm to provide leverage to a chain hoist mechanism that attaches to the post at a point superior to the arm.

None of the above inventions and patents, taken either singly or in combination, is seen to describe the instant invention as claimed.

SUMMARY OF THE INVENTION

The present invention provides a rugged and durable post puller in a format that allows it to be easily operated and transported by a single person as well as providing the ability to remove embedded posts from hardened ground.

Unlike the previous inventions, the present invention provides a solid, one piece, open sided, post engaging head constructed of hardened metal of a sufficient thickness and shape as to allow it to function under any conditions.

Accordingly, it is an object of the invention to provide a post pulling device with a sufficient mechanical advantage to remove deeply embedded posts from the ground.

It is another object of the invention to provide a post removing device constructed from material of a sufficient strength to allow the device to be subjected to relatively extreme conditions without damage.

It is a further object of the invention to provide a post pulling device which is lightweight and portable and allows a single person to quickly and efficiently engage the device and remove a fence post in a timely manner.

Still another object of the invention is to provide a post pulling device having an adjustable handle structure, both to allow for additional leverage and to allow the device to be stored in a compact and manageable arrangement.

An additional object of the invention is to provide a post pulling device having a C-shaped head which engages the post, wherein the head is rigidly constructed and angled in such a manner as to allow the device to "ratchet" down the post after each engagement of the handle.

It is again an object of the invention to provide a post pulling device having an interchangeable head structure to allow the device to engage and pull posts of various sizes and configurations.

Yet another object of the invention is to provide a post pulling device having a vertically adjustable post engaging section to facilitate the removal of posts of any height as well as to allow the user to tailor the device to his own size and strength.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
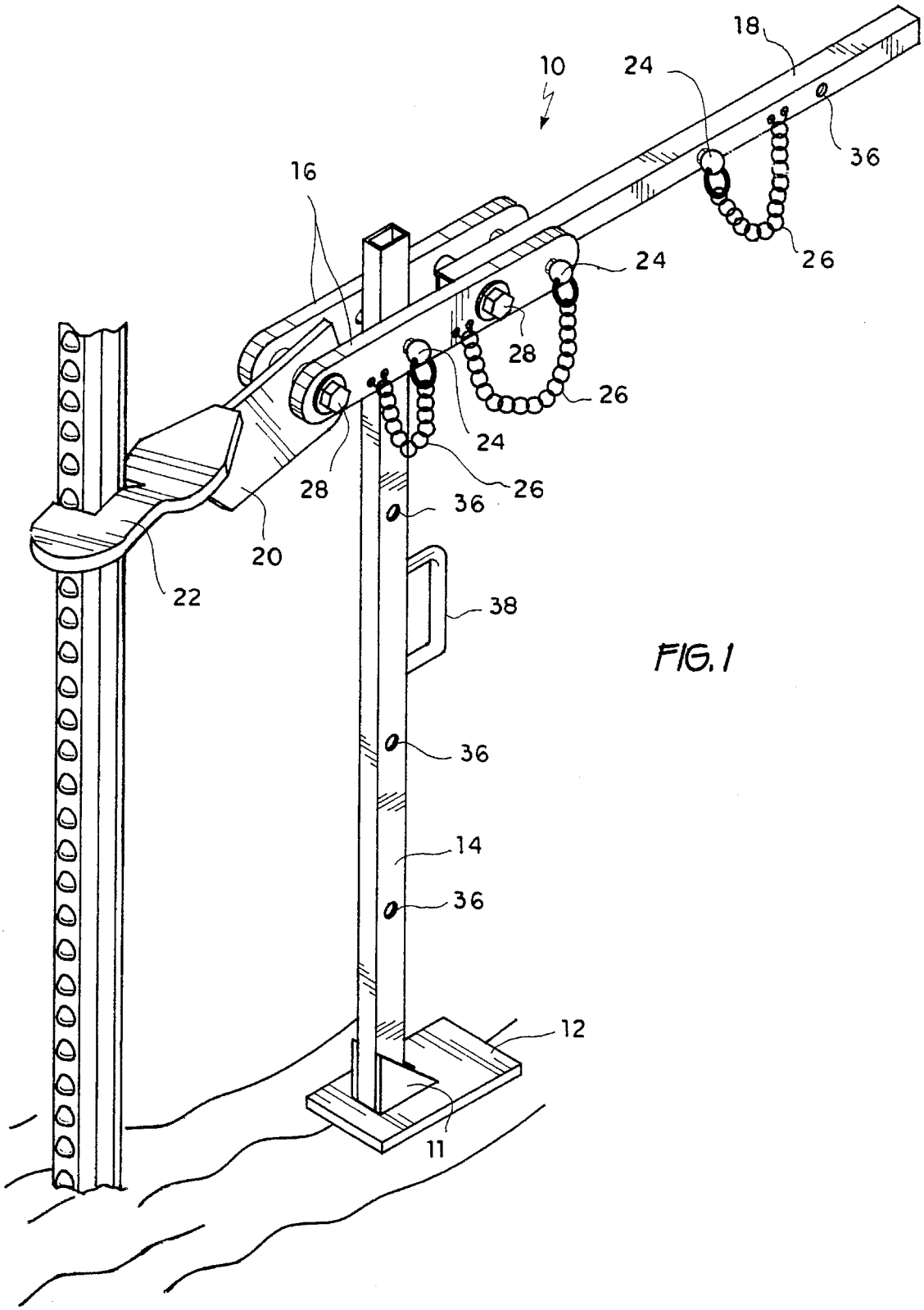
FIG. 1 is an environmental perspective view of a preferred embodiment of the invention in use.
Figure 2:
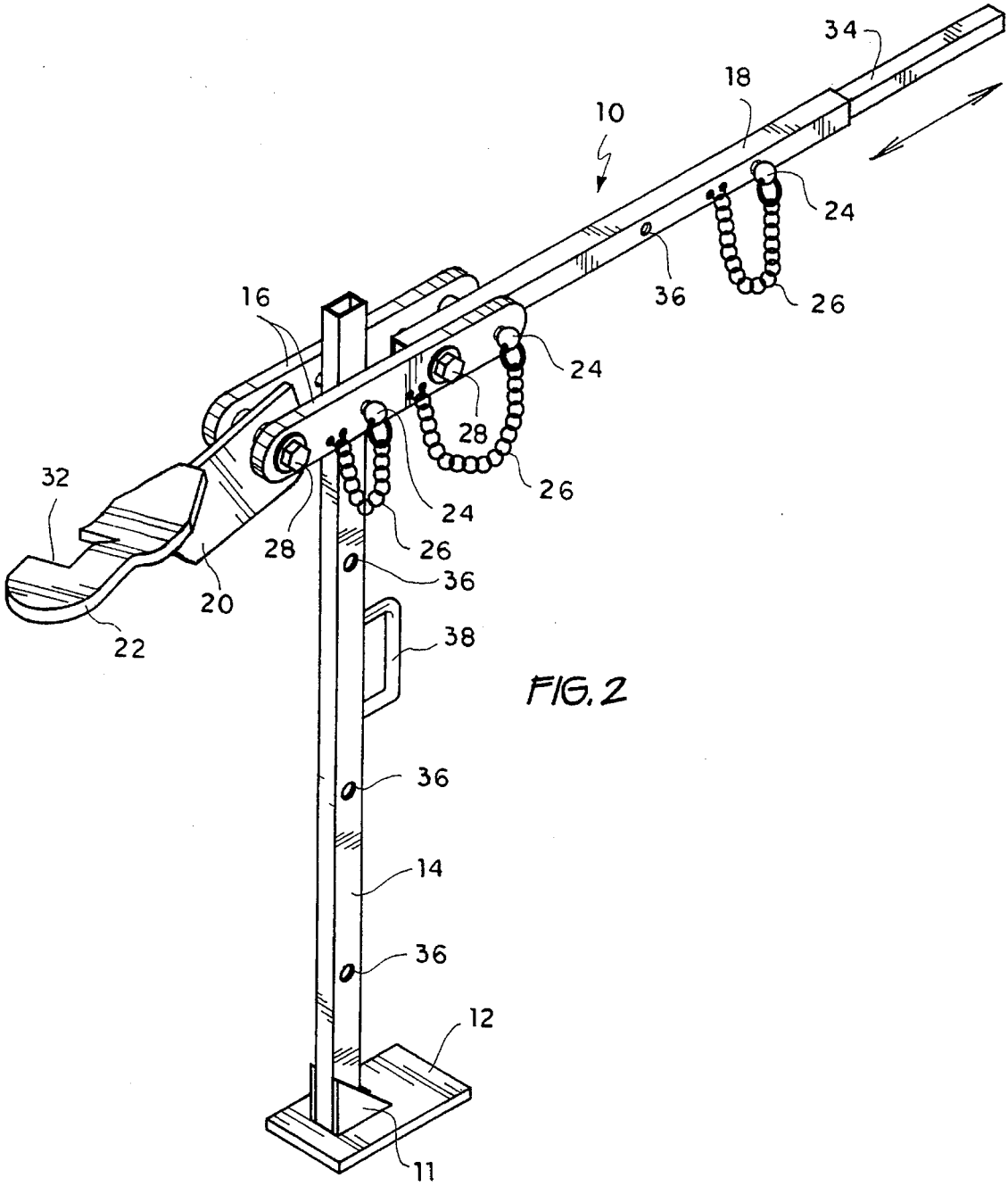
FIG. 2 is a perspective view of the post puller of this invention, and showing an extended handle.

Turning now to FIG. 1 of the drawings, a device for removing fence posts is shown. The post puller 10 is designed to be a free standing apparatus. A base plate 12 provides a planar support for the post puller 10. A vertical support element 14 is attached to the base plate 12. Ideally, the materials used to construct the post puller 10 would include rigid metal and metal box or square tubing, made of steel. The vertical support element is permanently fixed to the base plate 12 by welding or similar means. Additionally, bracing gussets 11 add strength to the connection.

A pair of plates 16 are pivotally attached to the vertical support 14. Together, these plates 16 form a yoke which links the extendable handle section 18 to the brace 20 and head 22 sections. The plates 16 are held in place with a pin 24 running through the plates 16 and the vertical support 14. The pin 24 is anchored to the plates 16 with a chain 26 or similar means. The vertical support 14 has a plurality of holes along its length to receive the pin 24 allowing the engagement plate 16 to be positioned at a variety of locations along the support 14.

Attached to one side of the engagement plate 16 is an extendable handle 18. The handle 18 is pivotable about a bolt 28 connecting the handle 18 to the engagement plate 16, in addition a second pin 24 and chain 26 are provided to lock the handle 18 in place with respect to the engagement plate 16. On the opposite side of the engagement plate 16, a brace plate 20 is attached with a bolt to allow it to pivot freely. The brace plate provides support for the C shaped head 22. The head has a notch 32 removed from it which allows the head to encompass a fence post. The brace plate 20 and head portion 22 are welded or otherwise permanently and securably fixed together and pivot as a unit about the axis of the bolt 28.

Emerging from the rear of the handle 18 is an extension 34 to the handle that provides additional leverage for the user. The extension 34 fits within the handle 18 and may secured with respect to the handle 18 by inserting a pin 24 through any number of through bores 36 found along the handle 18.

Figure 3:
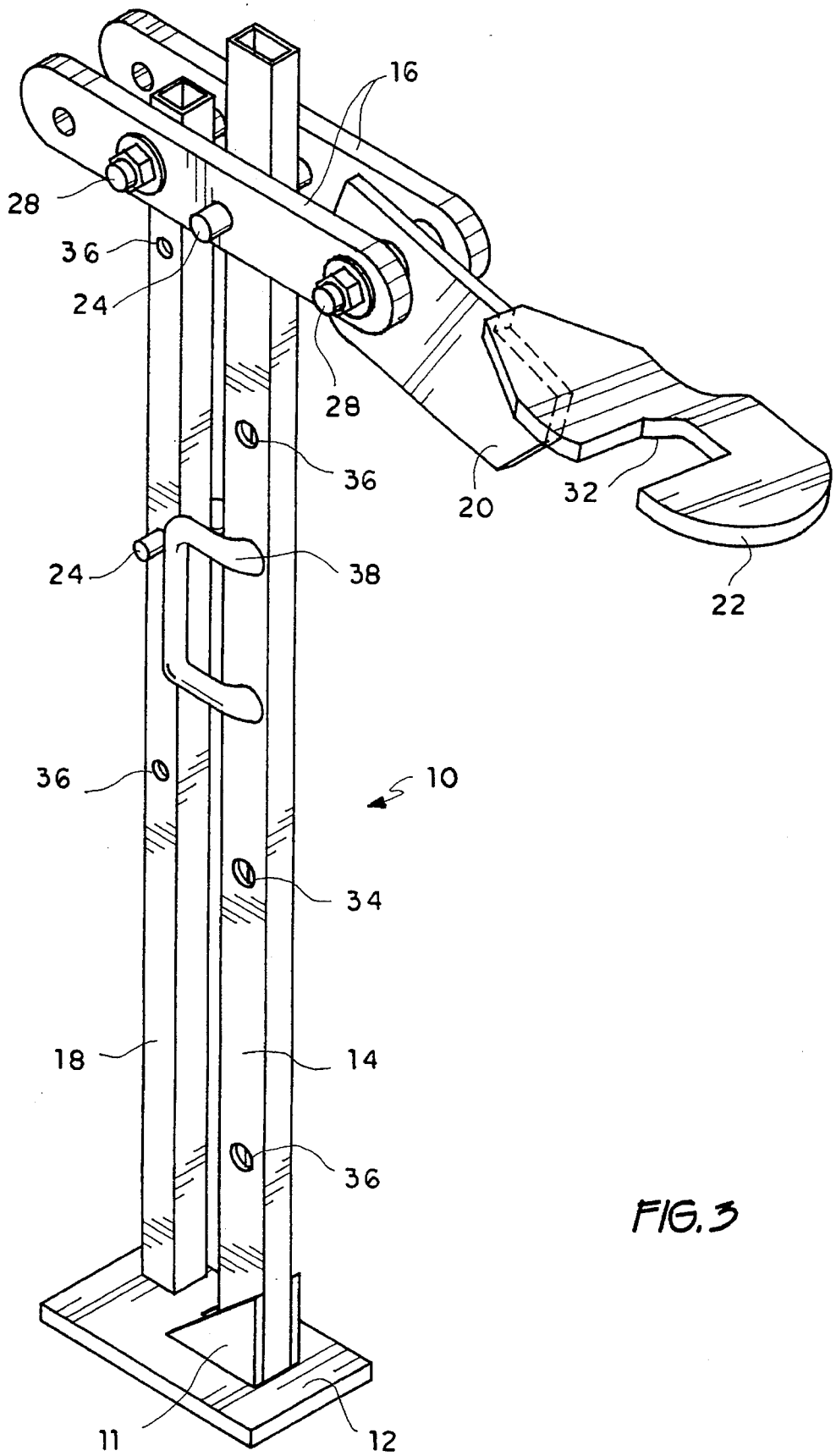
FIG. 3 is a perspective view of the invention in a collapsed position.

Prior to use the device 10 may be readily carried by one person to the location of a fence post. A carrying handle 38 is provided allowing the device 10 to be moved in a collapsed and balanced configuration. The extendable handle 18 can be pivoted down, as shown in FIG. 3, by using the carrying handle 38 gravity will keep the components properly arranged.

When ready to be used the device is configured as shown in FIG. 1, with the handle 18 locked into position. The head 22 is maneuvered around a fence post so that the front portion of the notch 32 engages the appropriate area of the post. With a T post the notch 32 will engage any one of the protrusions of the post, and with other types of posts a friction lock will be established by pinching the post between the opposite sides of the notch 32. The handle 18 is raised, the head engages the post, and downward pressure is applied to the handle 18 which raises the post out of the ground a corresponding amount. The handle 18 is raised again allowing the head to ratchet along the post and the process is repeated until the post is removed, usually few repetitions are required. The post puller 10 is simply carried to the next post or returned to storage, leaving a post that is in good condition and ready to be used again.

It is to be understood that the present invention is not limited to the sole embodiment described above, but encompasses any and all embodiments within the scope of the following claims.

I claim:

1. A device for removing a post, comprising;

a base plate formed from a generally planar element in engagement with the ground;

a vertical support element having a top and a bottom end;

said bottom end of said vertical support member being permanently attached to said base plate;

an elongated handle structure having a first and a second end;

an engagement plate having symmetrical right and left side members wherein each member has a front and a rear end;

said first end of said elongated handle structure being securably attached to said rear end of said right and left side members of said engagement plate; and a brace plate having a front and rear end wherein said brace plate forms a generally rectangular configuration having blunted corner portions;

said front end of said right and left side of said engagement plate being pivotably attached to said rear end of said brace plate;

said engagement plate being medially attached to said vertical support element in a pivotable fashion;

there further being a head portion of planar dimensions having a top face and a bottom face and a front end and a rear end;

said head portion having a rectangular notch removed medially from said head portion and extending across a substantial width of said head portion;

said bottom face of said rear end of said head portion being securably mounted to said front end of said brace plate at a substantially a ninety degree angle thereto;

said head portion being angled away from said brace plate beginning at said notch section and returning to a parallel plane at said front end of said head portion.

2. A device for removing a post according to claim 1, wherein said vertical support element has a plurality of through bores allowing said engagement plate to be pivotably attached to any of said through bores.

3. A device for removing a post according to claim 1, including, a telescoping handle section having a front end and a rear end, each end having a plurality of through bores a symmetrical distance from said ends;

said telescoping handle being retained within and adjustable along said elongated handle structure;

said elongated handle structure having at least two through bores corresponding to the said through bores of said telescoping handle;

a retaining pin or other retaining means being remotely connected by a flexible elongated means to said rear end of said elongated handle;

said retaining pin being inserted into said through bores to secure said telescoping handle to said elongated handle.

4. A device for removing a post according to claim 1, wherein said brace plate and said head portion are replaceable as a single unit.

5. A device for removing a post according to claim 1, wherein said notch removed from said head portion is proportioned to allow said head portion to encompass the width and depth of the fence post in its entirety.

6. A device for removing a post according to claim 1, wherein said head portion is angled in such a manner as to allow said head portion to ratchet down the length of the fence post with a lifting motion of said elongate handle.

7. A device for removing a post according to claim 1, including, a carrying handle portion attached to said vertical support element, wherein said carrying handle is offset from said vertical support element to allow said elongated handle to pivot into a parallel position with said vertical support element;

said carrying handle being oriented in such a manner as to allow said post removing device to be carried in a compact and balanced arrangement.

8. A device for removing a post according to claim 1, including, a triangular brace permanently fixed to said base plate and said vertical support element.

9. A device for removing a post according to claim 1, wherein, said first end of said handle structure is pivotally attached to said engagement plate, and said engagement plate further includes, a removable pin for locking said handle structure in place with respect to said engagement plate, and a chain anchoring said pin to said engagement plate.

* * * * *